US007690363B2

(12) United States Patent
Giacomazzi et al.

(10) Patent No.: US 7,690,363 B2
(45) Date of Patent: Apr. 6, 2010

(54) VAPOR ASSISTED COLD START ARCHITECTURE UTILIZING TANK GRADE VENT VALVES

(75) Inventors: Roy A. Giacomazzi, Auburn Hills, MI (US); Eugene V. Gonze, Pinckney, MI (US); Gregory E. Rich, New Baltimore, MI (US); Bernard Toton, Holly, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 46 days.

(21) Appl. No.: 11/688,424

(22) Filed: Mar. 20, 2007

(65) Prior Publication Data

US 2008/0230038 A1 Sep. 25, 2008

(51) Int. Cl.
*F02M 33/02* (2006.01)

(52) U.S. Cl. ..... 123/518; 123/519

(58) Field of Classification Search ..... 123/516, 123/520, 518, 519; 137/202, 565.17, 512.2, 137/587

See application file for complete search history.

(56) References Cited

U.S. PATENT DOCUMENTS 5,482,023 A * 1/1996 Hunt et al. ..... 123/491
5,584,278 A * 12/1996 Satoh et al. ..... 123/516
5,640,993 A * 6/1997 Kasugai et al. ..... 137/587
5,669,361 A * 9/1997 Weissinger et al. ..... 123/520
5,769,057 A * 6/1998 Hashimoto et al. ..... 123/516
5,782,258 A * 7/1998 Herbon et al. ..... 137/43
5,870,997 A * 2/1999 Mukai ..... 123/520
5,934,260 A * 8/1999 Gadkaree et al. ..... 123/520
6,145,532 A * 11/2000 Tuckey et al. ..... 137/202
6,450,192 B1 * 9/2002 Romanek ..... 137/202
6,868,837 B2 * 3/2005 Ament ..... 123/520
6,951,209 B2 * 10/2005 Yanase et al. ..... 123/516
6,986,341 B2 * 1/2006 Mitani et al. ..... 123/520

* cited by examiner

*Primary Examiner*—Stephen K Cronin
*Assistant Examiner*—J. Page Hufty

(57) ABSTRACT

A vapor fuel recovery system for fuel tanks is provided. The vapor recovery system comprises: a canister that captures vapor fuel expelled from the fuel tank; a vent valve that controls ventilation of vapor fuel from the fuel tank to the canister; and a vent bypass disposed between the canister and the vent valve that controls the flow of vapor fuel from the fuel tank to the on-board recovery canister when a fuel level in the fuel tank is full. The bypass includes a bypass valve and at least one orifice.

18 Claims, 3 Drawing Sheets

VAPOR ASSISTED COLD START ARCHITECTURE UTILIZING TANK GRADE VENT VALVES

FIELD OF THE INVENTION

The present invention relates to engine control systems, and more particularly to engine control systems that provide vapor enrichment of fuel flowing to an engine during cold start conditions.

BACKGROUND OF THE INVENTION

During combustion, an internal combustion engine oxidizes gasoline and combines hydrogen ($H_2$) and carbon (C) with air. Combustion creates chemical compounds such as carbon dioxide ($CO_2$), water ($H_2O$), carbon monoxide (CO), nitrogen oxides ($NO_x$), unburned hydrocarbons (HC), sulfur oxides ($SO_x$), and other compounds. A catalytic converter treats exhaust gases from the engine. An engine and catalytic converter are considered to be "cold" during an initial startup period after a long soak. During this cold start period, combustion of gasoline within the engine is incomplete. Further the catalytic converter does not operate optimally.

In an effort to optimize the functionality of the engine and catalytic converter during cold start conditions, vapor assist cold start methods and systems have been developed. The methods and systems facilitate the capturing of vapor fuels from a fuel tank and purging the vapor fuel as an additional source of fuel to the engine.

One deficiency in the conventional system is that when a fuel tank is full or the vehicle is sitting on a grade such that a fuel level vent valve (FLVV) of the vapor assist system closes, tank vapor space is substantially cut off to engine purge. The FLVV is designed to prevent fuel from being pumped into an on-board refueling vapor recovery (ORVR) canister when the vehicle is being re-fueled. The FLVV is not designed to remain open for engine purge when the fuel tank is full or the vehicle is resting on a grade.

SUMMARY OF THE INVENTION

Accordingly, a vapor fuel recovery system for fuel tanks is provided. The vapor recovery system comprises: a canister that captures vapor fuel expelled from the fuel tank; a vent valve that controls ventilation of vapor fuel from the fuel tank to said canister; and a vent bypass disposed between the canister and the vent valve that controls the flow of vapor fuel from the fuel tank to said on-board recovery canister when a fuel level in the fuel tank is full. The bypass includes a bypass valve and at least one orifice.

In other features, the bypass valve is mechanical and the bypass valve opens and closes based on engine vacuum.

In still other features, the bypass valve is electronically controlled. The vapor fuel recovery system further comprises a control module that determines a cold start condition of an engine and determines a desire for vapor fuel and controls the bypass valve based on a the cold start condition and the desire for vapor fuel.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1A:
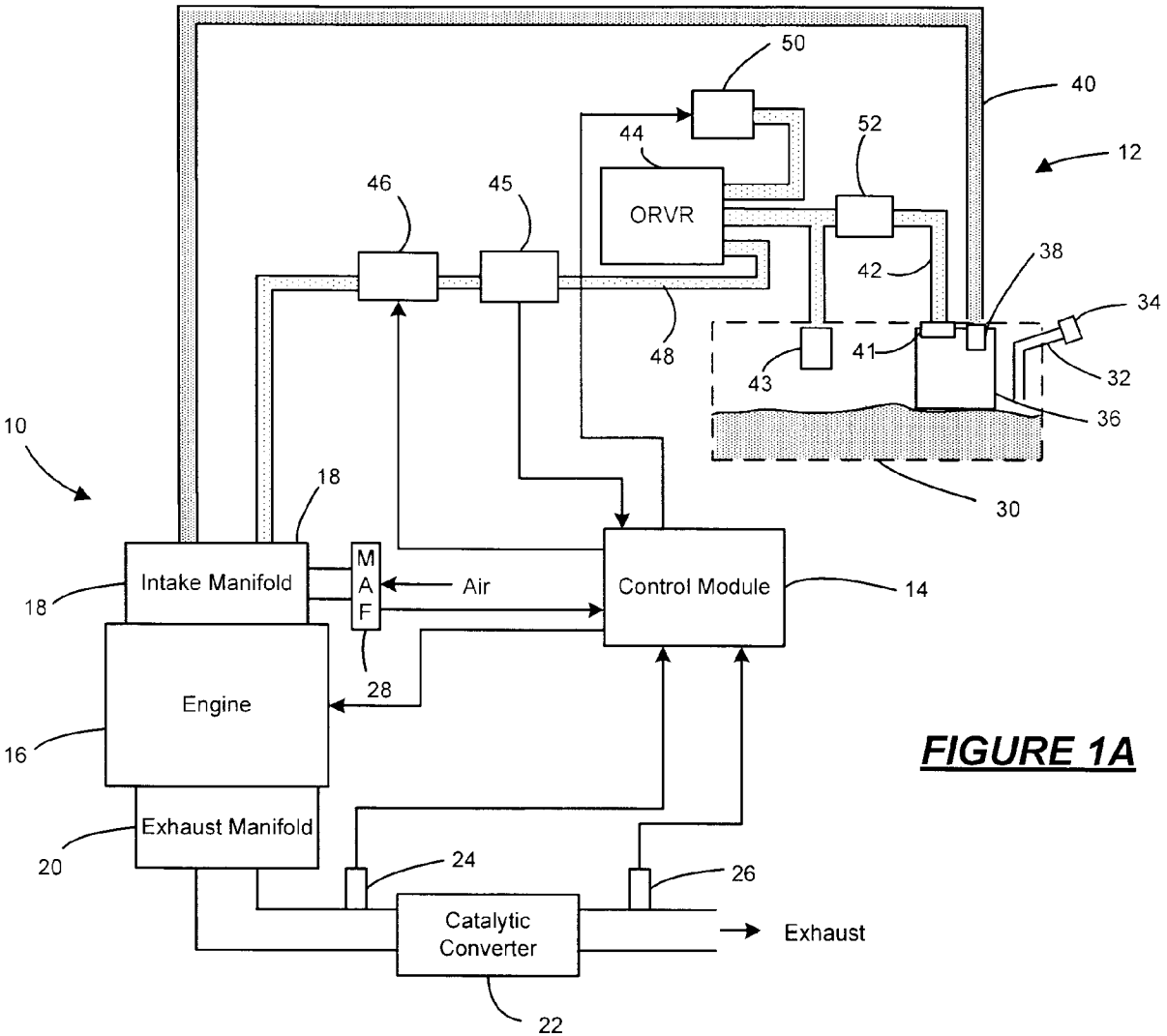
FIG. 1A is a functional block diagram of an engine control system and a fuel control system including a grade vent bypass valve.

The following description of the preferred embodiment(s) is merely exemplary in nature and is in no way intended to limit the invention, its application, or uses. For purposes of clarity, the same reference numbers will be used in the drawings to identify similar elements. As used herein, the term module refers to an application specific integrated circuit (ASIC), an electronic circuit, a processor (shared, dedicated, or group) and memory that executes one or more software or firmware programs, a combinational logic circuit, and/or other suitable components that provide the described functionality.

Referring to FIG. 1, an engine system 10 and a fuel system 12 are shown. One or more control modules 14 communicate with the engine and fuel system 10, 12. The fuel system 12 selectively supplies liquid and/or vapor fuel to the engine system 10, as will be described in further detail below.

The engine system 10 includes an engine 16, an intake manifold 18, and an exhaust manifold 20. Air and fuel are drawn into the engine 16 and combusted therein. Exhaust gases flow through the exhaust manifold 20 and are treated in a catalytic converter 22. First and second $O_2$ sensors 24 and 26 communicate exhaust A/F ratio signals to the control module 14. A mass airflow sensor 28 communicates a mass airflow signal to the control model 14. The control module 14 determines a desired A/F ratio based on the A/F ratio signal, the MAF signal, and other engine operating conditions. The control module controls air, fuel, and/or vapor fuel levels based on the desired A/F ratio.

The fuel system 12 includes a fuel tank 30 that contains liquid fuel and fuel vapor. A fuel inlet 32 extends from the fuel tank 30 to allow fuel filling. A fuel cap 34 closes the fuel inlet 32 and may include a bleed hole (not shown). A modular reservoir assembly (MRA) 36 is disposed within the fuel tank 30 and includes a fuel pump 38. A liquid fuel line 40 and a vapor fuel line 42 extend from the MRA 36.

The fuel pump 38 pumps liquid fuel through the liquid fuel line 40 to the engine 16. A grade vent valve 41, allows vapor fuel to be vented from the fuel tank to an on-board refueling vapor recovery (ORVR) canister 44. A fuel level vent valve 43 (FLVV) is disposed within the fuel tank. When open, the FLVV 43 allows vapor fuel to flow through the vapor fuel line to the ORVR canister 44. The FLVV 43 is designed to prevent liquid fuel from entering the ORVR during fueling events. A vapor fuel line 48 connects a vapor sensor 45, a purge solenoid valve 46 and the ORVR canister 44. The control module 14 modulates the purge solenoid valve 46 to selectively enable vapor fuel flow to the engine 16. The control module 14 modulates a canister vent solenoid valve 50 to selectively enable air flow from atmosphere into the ORVR canister 44.

Figure 1B:
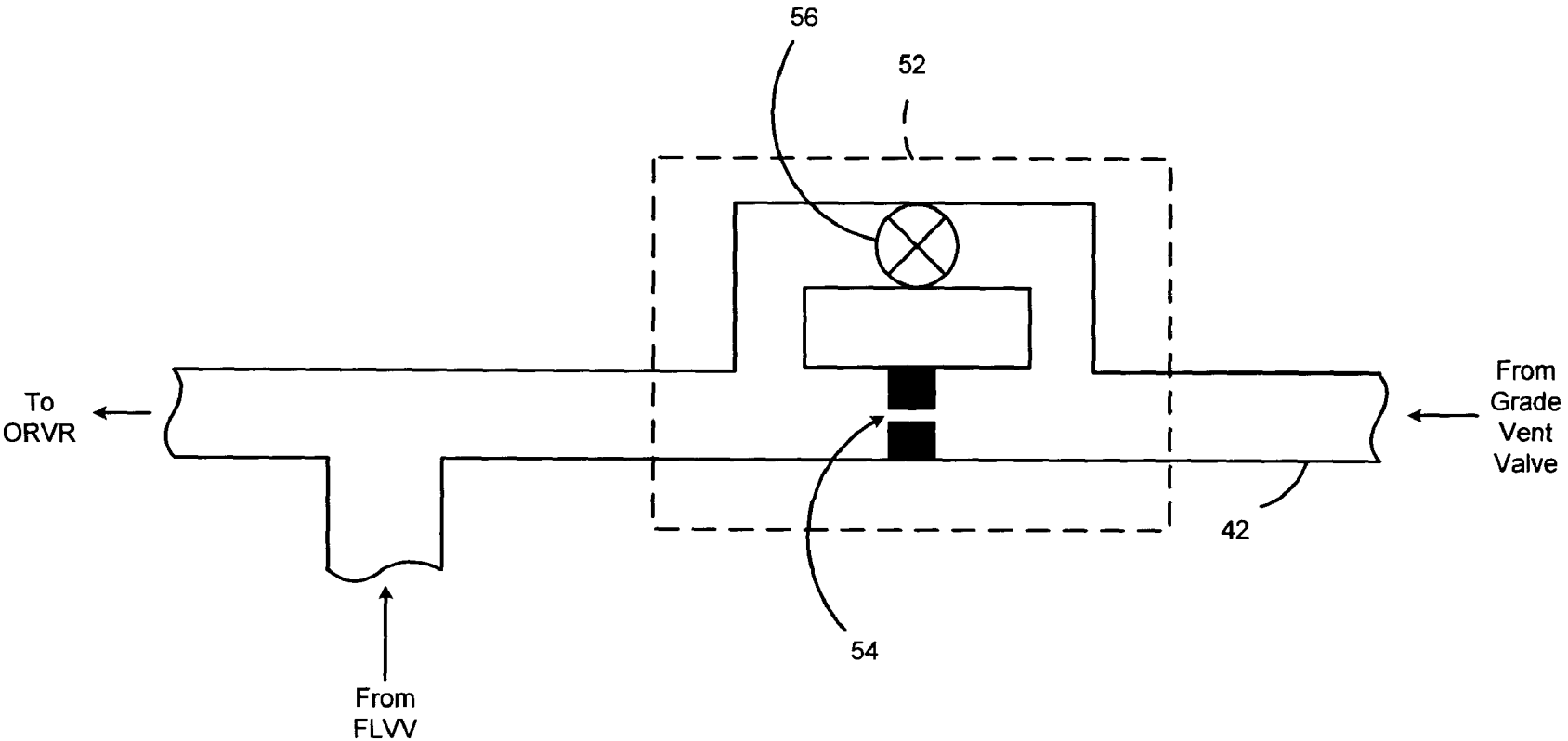
FIG. 1B is a diagram of an exemplary grade vent bypass valve.

A fuel system according to the present invention includes a grade vent bypass 52 disposed between the grade vent valve 41 and the ORVR canister 44. Referring to FIG. 1B, the grade vent bypass 52 includes at least one orifice, such as orifice 54, and a bypass valve 56. The orifice 54 allows for tank vapor to vent to the ORVR canister 44 when the bypass valve 56 is closed. Orifices of the grade vent bypass valve 52 can be in place of or in addition to conventional orifices of the grade vent valve 41. As can be appreciated, the bypass valve 56 can be mechanical or electrical. The bypass valve 56 allows for engine access to vapor space in the fuel tank when the FLVV 43 is closed.

Figure 2:
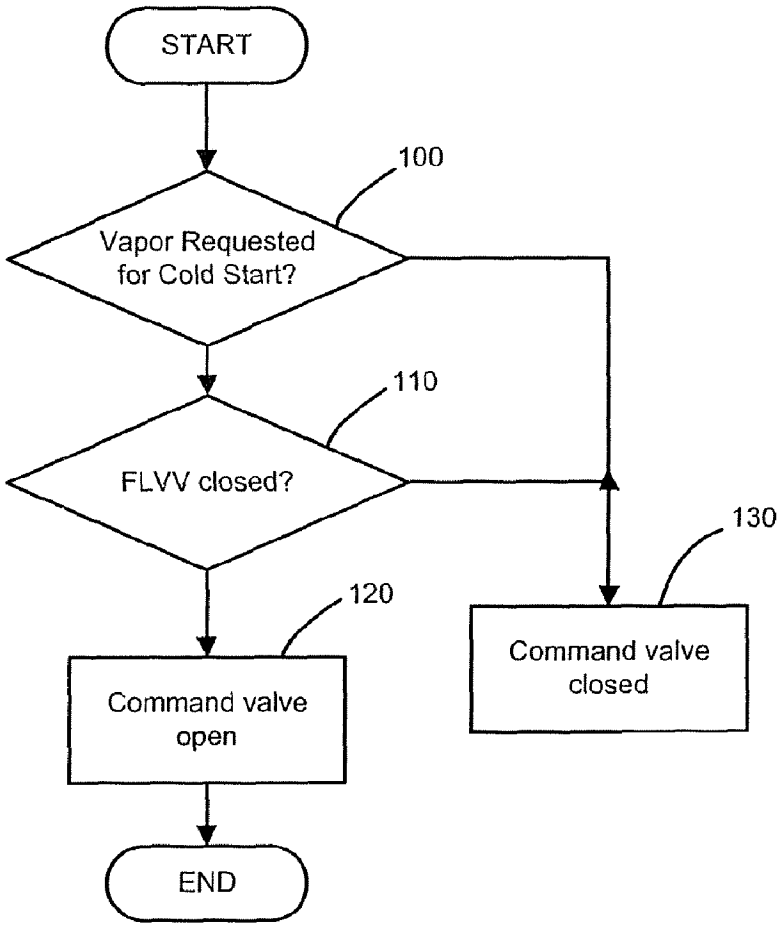
FIG. 2 is a flowchart illustrating a control method for an electrical grade vent orifice bypass valve.

Either vacuum from the engine purge or an electrical valve can act to open the bypass valve 56. FIG. 2 illustrates a control method for operating the bypass valve 56. If vapor is requested under cold start conditions at 100 and the FLVV 43 is closed at 110, control commands the bypass valve 56 open at 120. Otherwise, control commands the bypass valve 56 shut at 130.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification, and the following claims.

What is claimed is:

1. A vapor fuel recovery system for a fuel tank, comprising:

a canister that captures vapor fuel expelled from the fuel tank;

a vent valve that controls ventilation of vapor fuel from the fuel tank to said canister; and a vent bypass disposed between said canister and said vent valve that comprises a bypass valve and an orifice, wherein fuel vapor flows through said orifice when said bypass valve is closed, and wherein said orifice remains open.

2. The system of claim 1 wherein said bypass valve is mechanical.

3. The system of claim 2 wherein said bypass valve opens and closes based on engine vacuum.

4. The system of claim 1 wherein said bypass valve is electronically controlled.

5. The system of claim 1 further comprising a control module that determines a cold start condition of an engine, selectively determines a vapor fuel demand, and controls said bypass valve based on said cold start condition and said vapor fuel demand.

6. The system of claim 5 wherein said bypass valve is opened when said cold start condition and said vapor fuel demand are present.

7. The system of claim 1 wherein said bypass valve is controlled based on an engine start event and an engine temperature.

8. The system of claim 7 wherein said bypass valve is also controlled based on a vapor fuel request.

9. The system of claim 8 wherein said bypass valve is opened during a predetermined period after said engine start event when said engine temperature is less than a threshold temperature and said vapor fuel request is received.

10. The system of claim 8 further comprising a fuel level vent valve, wherein said bypass valve is also controlled based on a position of said fule level vent valve.

11. The system of claim 10 wherein said bypass valve is opened during a predetermined period after said engine start event when said engine temperature is less than a threshold temperature, said vapor fuel request is received, and said fuel level vent valve is in a closed position.

12. A vapor fuel recovery system for a fuel tank, comprising:

a canister that captures vapor fuel expelled from the fuel tank;

a vent valve that controls ventilation of vapor fuel from the fuel tank to said canister; and a vent bypass comprising a bypass valve and an orifice that are in parallel and that regulate vapor fuel flow between said canister and said vent valve, wherein said orifice is always open.

13. The system of claim 12 wherein said bypass valve is controlled based on an engine start event and an engine temperature.

14. The system of claim 13 wherein said bypass valve is also controlled based on a vapor fuel request.

15. The system of claim 13 wherein said bypass valve is opened during a predetermined period after said engine start event when said engine temperature is less than a threshold temperature and said vapor fuel request is received.

16. The system of claim 14 further comprising a fuel level vent valve, wherein said bypass valve is also controlled based on a position of said fuel level vent valve.

17. The system of claim 16 wherein said bypass valve is opened during a predetermined period after said engine start event when said engine temperature is less than a threshold temperature, said fuel level vent valve is in a closed position, and said vapor fuel request is received.

18. A vapor fuel recovery system for a fuel tank, comprising:

a canister that captures vapor fuel expelled from the fuel tank;

a vent valve that controls ventilation of vapor fuel from the fuel tank to said canister; and a vent bypass disposed between said canister and said vent valve that comprises a bypass valve and an orifice, wherein vapor fuel flows through said orifice when said bypass valve is closed, and wherein said orifice is always open.

* * * * *